US009388817B1

(12) United States Patent
Wright et al.

(10) Patent No.: US 9,388,817 B1
(45) Date of Patent: Jul. 12, 2016

(54) PREHEATING OF FLUID IN A SUPERCRITICAL BRAYTON CYCLE POWER GENERATION SYSTEM AT COLD STARTUP

(75) Inventors: Steven A. Wright, Albuquerque, NM (US); Robert L. Fuller, Conifer, CO (US)

(73) Assignee: Sandia Corporation, Albuquerque, NM (US)

( * ) Notice: Subject to any disclaimer, the term of this patent is extended or adjusted under 35 U.S.C. 154(b) by 400 days.

(21) Appl. No.: 13/070,910

(22) Filed: Mar. 24, 2011

(51) Int. Cl.

| | |
|---|---|
| ***F04D 25/04*** | (2006.01) |
| ***F04D 29/063*** | (2006.01) |
| ***F02B 39/10*** | (2006.01) |
| ***F02B 39/14*** | (2006.01) |

(52) U.S. Cl.
CPC ..... *F04D 25/04* (2013.01); *F02B 39/10* (2013.01); *F02B 39/14* (2013.01); *F04D 29/063* (2013.01)

(58) Field of Classification Search
CPC ..... F02B 39/10; F02B 39/14; F04D 25/04; F04D 29/063
USPC ..... 60/39.01, 39.05, 39.26, 39.55, 646, 60/659, 775, 793, 650, 682
See application file for complete search history.

(56) References Cited

U.S. PATENT DOCUMENTS

| | | | | |
|---|---|---|---|---|
| 2,882,687 | A * | 4/1959 | Stivender | 60/661 |
| 3,788,066 | A * | 1/1974 | Nebgen | 60/775 |
| 6,564,556 | B2 * | 5/2003 | Ginter | 60/775 |
| 6,910,335 | B2 | 6/2005 | Vitero et al. | |
| 7,154,931 | B2 | 12/2006 | Emanuel | |
| 7,466,045 | B2 | 12/2008 | Andres | |
| 7,695,260 | B2 | 4/2010 | Holtzapple et al. | |
| 7,726,959 | B2 | 6/2010 | Holtzapple et al. | |
| 2007/0245735 | A1 * | 10/2007 | Ashikian | 60/659 |
| 2010/0154381 | A1 | 6/2010 | Rapp et al. | |
| 2010/0156112 | A1 | 6/2010 | Held et al. | |

FOREIGN PATENT DOCUMENTS

WO WO 2010129274 A2 * 11/2010

OTHER PUBLICATIONS

Angelino G., "Perspectives for the Liquid Phase Compression Gas Turbine", Journal of Engineering for Power, Trans. ASME, vol. 89, No. 2, pp. 229-237, Apr. 1967.
Angelina G., "Carbon Dioxide Condensation Cycles for Power Production", ASME Paper No. 68-GT-23, pp. 1-9, 1968.
Angelina G., "Real Gas. Effects in Carbon Dioxide Cycles", ASME Paper No. 69-GT-102, pp. 1-12, 1989.
Dostal V. Driscoll, M.J. and Hejzlar, P. "A Supercritical Carbon Dioxide Cycle for Next Generation Nuclear Reactors," MIT-ANP-TR-100, Mar. 2004.
Hoffman, et al., "150 Kwe Supercritical Closed Cycle System ", Transactions of the ASME, pp. 70-80, Jan. 1971.

* cited by examiner

*Primary Examiner* — Jesse Bogue
*Assistant Examiner* — Paul Thiede
(74) *Attorney, Agent, or Firm* — Daniel J. Jenkins

(57) ABSTRACT

Various technologies pertaining to causing fluid in a supercritical Brayton cycle power generation system to flow in a desired direction at cold startup of the system are described herein. A sensor is positioned at an inlet of a turbine, wherein the sensor is configured to output sensed temperatures of fluid at the inlet of the turbine. If the sensed temperature surpasses a predefined threshold, at least one operating parameter of the power generation system is altered.

11 Claims, 10 Drawing Sheets

PREHEATING OF FLUID IN A SUPERCRITICAL BRAYTON CYCLE POWER GENERATION SYSTEM AT COLD STARTUP

STATEMENT OF GOVERNMENTAL INTEREST

This invention was developed under contract DE-AC04-94AL85000 between Sandia Corporation and the U.S. Department of Energy. The U.S. Government has certain rights in this invention.

BACKGROUND

Due to environmental concerns as well as increasing population, environmentally friendly and efficient power generation systems are desired. While there have recently been advances in systems that utilize renewable resources, such as solar power, wind, geothermal energy, and the like efficiencies of such systems trails conventional turbine-based power generation systems, and costs of building such systems is relatively high. Moreover, generally, systems that utilize renewable resources output variable amounts of electrical power (e.g., depending upon cloud cover, wind speeds, . . . ).

Supercritical Brayton cycle power generation systems have been proposed and theorized as efficient power generation systems. Advantages of Brayton cycle power generation systems include the utilization of environmentally friendly, naturally occurring elements compounds such as air, carbon dioxide, nitrogen, helium, etc. Additional advantages of supercritical Brayton cycle power generation systems include a relatively small footprint when compared to conventional turbine-based power generation systems. Moreover, supercritical Brayton cycle power generation systems have been theorized to have efficiencies that meet or exceed efficiencies of conventional power generation systems.

Supercritical Brayton cycle power generation systems offer a promising approach to achieving higher efficiency and more cost-effective power conversion when compared against existing steam-driven power plants, and also perhaps gas turbine power plants. A supercritical Brayton cycle power generation system is a power conversion system that utilizes a single-phase fluid operating near the critical temperature and pressure of such fluid. Generally, two types of power conversion cycles have been proposed: a recuperated Brayton cycle and a recompression Brayton cycle. Other types of power cycles, such as a power take off cycle, cycles with reheat or intercooling, and split-flow compressor discharge cycles that heat a fraction flow rather than recuperate it, can also be utilized, wherein such cycles employ a Brayton cycle. Issues caused by densities of fluids that can be employed in a Brayton cycle power generation system can render designing such a system problematic, particularly at cold start up of such a system.

SUMMARY

The following is a brief summary of subject matter that is described in greater detail herein. This summary is not intended to be limiting as to the scope of the claims.

In general, various technologies pertaining to supercritical Brayton cycle power generation systems are described herein. More particularly, various technologies pertaining to controlling flow direction of fluid at cold startup start up in a supercritical Brayton cycle power generation are described herein. A supercritical Brayton cycle power generation system includes a generator and a turbine that is configured to drive a generator by way of a shaft that couples the turbine to the generator. When operating at design temperatures/pressures, a compressor is configured to compress supercritical fluid and transmit such compressed fluid to a heater. The heater is operative to heat the fluid, which causes the fluid to expand towards the turbine, which in turn causes the turbine to rotate the shaft and generate electrical power at the generator. At start up of such a supercritical Brayton cycle power system, however, the temperature of the fluid may be at room temperature, which causes the density of the fluid to be up to ten times greater than the density of the fluid at designed operating conditions of the supercritical Brayton cycle power generation system. This can effectively cause the turbine to act as a compressor (for radial turbomachinery), which therefore causes the fluid to flow in a reverse direction through the heater, the turbine, and/or the compressor in the power generation system. Since the fluid will not flow to the inlet of the heater, the fluid cannot be heated to the designed operating temperature. Moreover, since the fluid may flow backwards through various components of the power generation system, extensive damage to such system may be caused.

Numerous approaches to designing a supercritical Brayton cycle power generation system to overcome the aforementioned reverse flow difficulties are contemplated and described herein. With more particularly, a sensor configured to sense the temperature of the fluid can be positioned at an inlet port of the turbine. Based at least in part upon the temperature that output by the sensor, at least one operating parameter of the supercritical Brayton cycle power generation system can be controlled. In an example, bypass piping line may be positioned in the supercritical Brayton cycle power system between the inlet port and the outlet port of the turbine. Furthermore, a valve can be positioned on such bypass piping. In such a design, the at least one operating parameter of the supercritical Brayton cycle power generation system that is controlled based at least in part upon the sensed temperature of the fluid at the inlet port of the turbine may pertain to the valve on the bypass piping (e.g. opened, partially opened, rate of closing, closed, . . . ).

In another example, a pump or recirculator can be placed in the supercritical Brayton cycle power generation system that causes the fluid to flow to the inlet of the heater. Accordingly, the at least one operating parameter that is control based at least in part upon the temperature at the inlet port of the turbine can operate such pump or recirculator. For example, when the temperature sensed by the sensor at the inlet port of the turbine is above a threshold temperature, the pump can be slowed or shut down. In still yet another example, the at least one operating parameter that can be controlled based at least in part upon the sensed fluid temperature at the inlet of the turbine can be the speed of a motor that is configured to drive the compressor. For instance, prior to the temperature of the fluid at the inlet port of the turbine reaching a threshold temperature, the motor can operate at a first speed. Subsequent to the temperature of the fluid at the inlet port of the turbine reaching the threshold temperature, power provided to the motor can increase to cause the motor to operate at a second speed. These and other designs that act to effectively preheat the fluid in the supercritical Brayton cycle power generation system and allow the fluid to flow in a desired direction will be described in greater detail herein Other aspects will be appreciated upon reading and understanding the attached figures and description.

DETAILED DESCRIPTION

Figure 1:
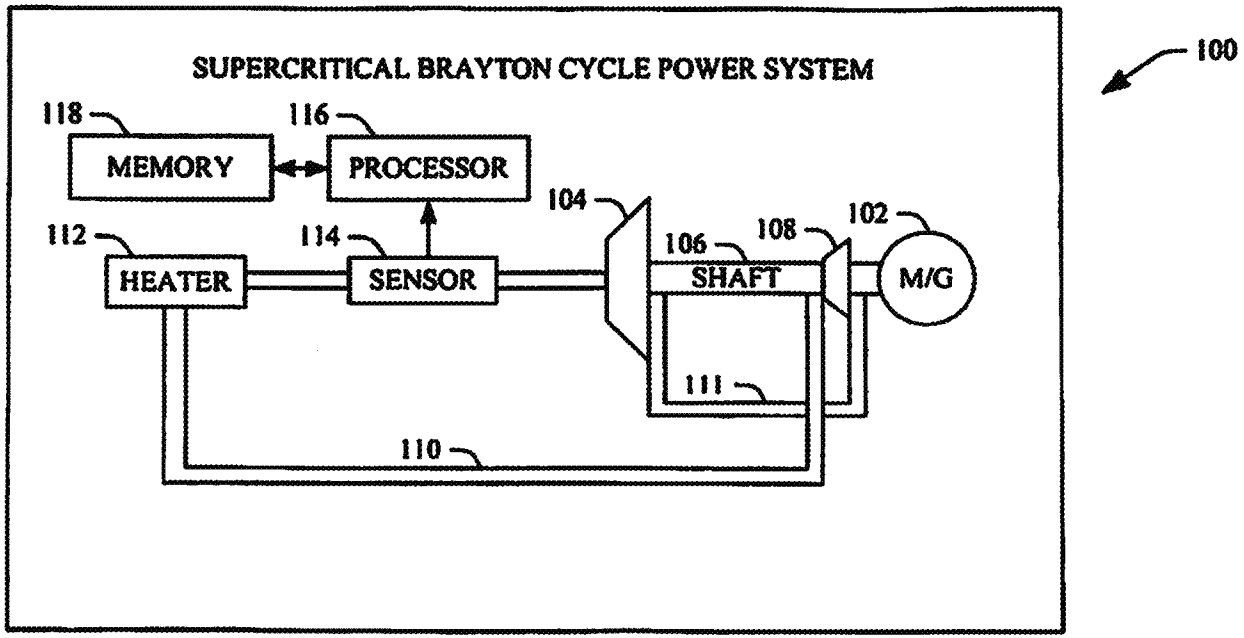
FIG. 1 is a functional block diagram of an exemplary supercritical Brayton cycle power generation system.

Various technologies pertaining to supercritical Brayton cycle power generation systems will now be described with reference to the drawings, where like reference numerals represent like elements throughout. It is to be understood that the term "exemplary", as used herein, is defined as serving as an illustration or example, and is not intended to indicate a preference.

FIG. 1 is a functional block diagram of an exemplary supercritical Brayton cycle power generation system 100. The supercritical Brayton cycle power generation system 100 is a power conversion system that, when operating at designed temperature/pressure, utilizes a single phase fluid operating near the critical temperature and pressure of such fluid. In an example, the fluid may be carbon dioxide. In another example, the fluid may sulfur hexafluoride. Moreover, the fluid may be some other suitable refrigerant. The supercritical Brayton cycle power generation system may be employed in a variety of settings. For instance, the supercritical Brayton cycle power generation system 100 may be utilized in a power plant. Additionally or alternatively, the supercritical Brayton cycle power generation system 100 may be employed as a heat transfer system. Therefore, for example, the supercritical Brayton cycle power generation system 100 may be utilized to provide electrical power to residences, to an enterprise, or the like. Furthermore, the supercritical Brayton cycle power generation system 100 may be employed to provide electrical power to one or more mobile vehicles such as a ship, an aircraft carrier, a submarine, a large airplane, or the like.

Figure 2:
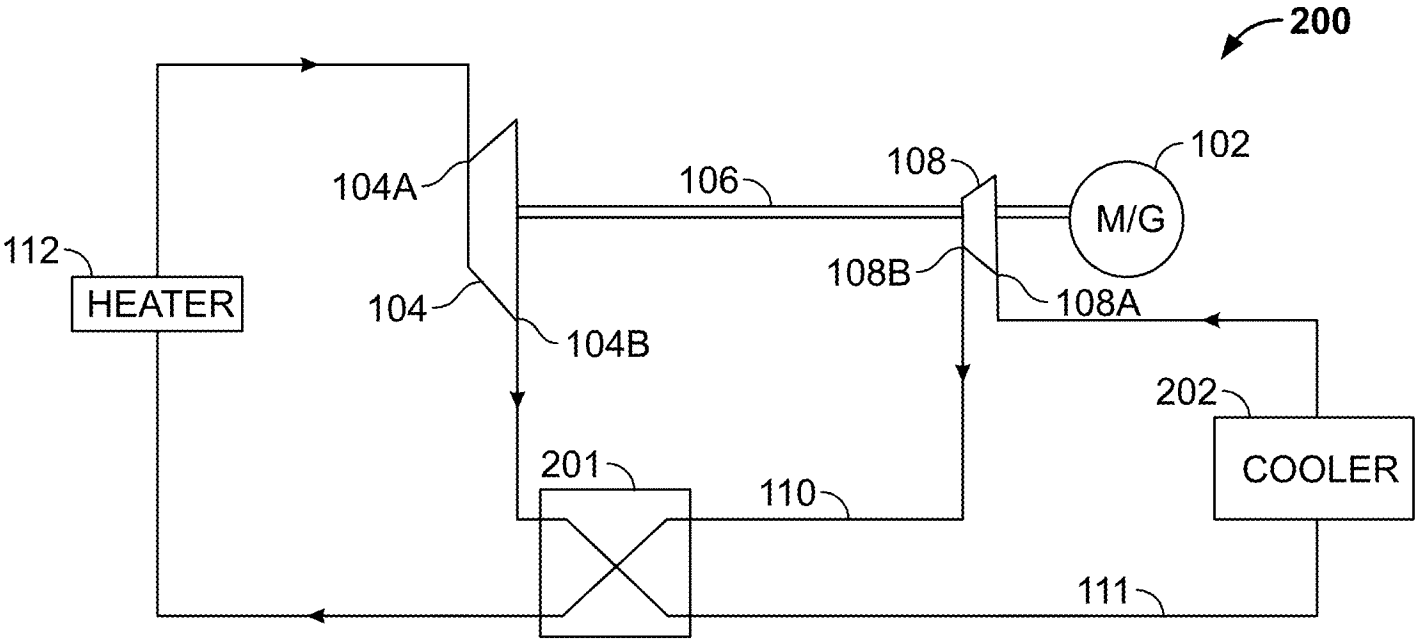
FIG. 2 illustrates a schematic diagram of a recuperated supercritical Brayton cycle power generation system.

Referring to FIG. 2, the supercritical Brayton cycle power generation system 100 comprises a motor/generator 102. In this exemplary power generation system 100, the motor/generator 102 may be a single unit. It is to be understood, however, that in some embodiments, it may be desirable to include a separate motor and generator. The power generation system 100 further comprises a turbine 104, wherein the turbine 104 includes an inlet port 104A and an outlet port 104B. When operating as designed, the inlet port 104A of the turbine 104 receives supercritical fluid, which causes the turbine 104 to rotate. The fluid exits the turbine 104 through outlet port 104B. The power generation system 100 further comprises a shaft 106 that operatively couples the turbine 104 to the motor/generator 102, wherein rotation of the turbine 104 in a first radial direction is operative to cause the motor/generator 102 to output electric power. That is, as the turbine 104 is driven by fluid passing therethrough, the turbine 104 causes the shaft 106 to rotate, which in turn causes the motor/generator 102 to generate electric power.

The supercritical Brayton cycle power generation system 100 further comprises a compressor 108, wherein the compressor 108 comprises an inlet port 108A and an outlet port 108B. The inlet port 108A of the compressor 108 is configured to receive fluid from the turbine 104 (subsequent to such fluid being cooled by a cooling mechanism), and compress such fluid. Fluid exits the compressor 108 by way of the outlet port 108B, and is directed towards the inlet port 104A of the turbine 104 (subsequent to being heated by a heating mechanism). The motor portion of the motor/generator 102 is configured to drive the compressor 108. Pursuant to an example, the compressor 108 can be a radial compressor, an axial compressor, a shaft-driven piston mechanism, or the like.

The power generation system 100 further comprises first piping 110 that is operative to transport fluid that exits the outlet port 108B of the compressor 108 to the inlet port 104A of the turbine 104. As used herein, the term "first piping" is intended to encompass all portions of piping in a supercritical Brayton cycle power generation system that are utilized to transport fluid from the outlet port 108B of the compressor 108 to the inlet port 104B of the turbine 104. The supercritical Brayton cycle power generation system 100 additionally comprises second piping 111 that is configured to transport fluid from the outlet port 104B of the turbine 104 to the inlet port 108A of the compressor 108. As used herein, the term "second piping" is intended to encompass all portions of piping in a supercritical Brayton cycle power generation system that are utilized to transport fluid from the outlet port 104B of the turbine 104 to the inlet port 108A of the compressor 108. Piping in the supercritical Brayton cycle power generation system 100 may be stainless steel, copper or some other suitable metal that can be utilized to transport for instance, carbon dioxide that is at or near its critical temperature/pressure. A heater 112 is placed along the first piping 110, wherein the heater 112 is operative to increase the heat of the fluid received by way of the first piping 110. For instance, the heater 112 may be configured to increase the heat of fluid received by way of the first piping 110 by 75°, 100°, 125°, 150°, or 200° Celsius. The heater 112 can be or include any suitable heat source or heating apparatus, including a nuclear heat source, a solar powered heat source, a fossil fuel heat source, or the like.

A sensor 114 is placed in or along the first piping 110 proximate to the inlet port 104A of the turbine 104, and is operative to sense a temperature of the fluid at the inlet port 104A of the turbine 104. A computer processor 116 can receive temperature values output by the sensor 114 and can control at least one operating parameter of the supercritical Brayton cycle power generation system 100 based at least in part upon these receiver temperature values. More specifically, the processor 116 may have access to a memory 118 that retains a threshold temperature and computer readable instructions that facilitate comparing a sensed temperature output by the sensor 114 with the threshold temperature retained in memory 118. The memory 118 may further comprise instructions that facilitate controlling at least one operating parameter of the power generation system 100 based at least in part upon the comparison between the threshold temperature and the sensed temperature.

As will be shown and described in greater detail herein, a supercritical Brayton cycle power generation system 100 may optionally include bypass piping and a valve thereon, wherein the valve can be operated (e.g., fully opened, slowly closed, fully closed) based at least in part upon the temperature at the inlet of the turbine 104 output by the sensor 114. In another example, the supercritical Brayton cycle power generation system 100 may include a recirculator (pump), and the processor 116 can be configured to control operation of the recirculator based at least in part upon the temperature at the inlet of the turbine 104 output by the sensor 114. In still yet another example, the heater 112 can be operated based at least in part upon a sensed temperature of the fluid at the inlet port 104A of the turbine 104. For instance, an amount of heat that is output by the heater 112 can be based at least in part upon such sensed temperature. Moreover, more than one operating condition of the power generation system 100 can be controlled based at least in part upon the temperature at the inlet port 104A of the turbine 104 as output by the sensor 114.

Referring again to FIG. 2, a schematic diagram of an exemplary recuperated supercritical Brayton cycle power generation system 200 is illustrated. The power generation system 200 comprises the turbine 104, the shaft 106, the compressor 108, the motor/generator 102, the first piping 110, the second piping 111, and the heater 112. The supercritical Brayton cycle power generation system 200 further comprises a recuperator 201 that acts to transfer heat in the fluid in the second piping 111 to fluid in the first piping 110. The power generation system 200 further comprises a cooler 202 is operative to cool fluid that has exited the turbine 104 by way of the outlet port 104B of the turbine 104 prior to being received at the inlet port 108A of the compressor 108. The compressor 108 compresses such cooled fluid, which exits the compressor 108 by way of the outlet port 108B and passes through the recuperator 201, where the fluid picks up heat from fluid exiting the turbine 104 in the second piping 111. The heater 112 receives such fluid in the first piping 110, provides additional heat to the fluid, and transfers the fluid to the inlet port 104A of the turbine 104. It is to be understood that the supercritical Brayton cycle power generation system 200 may further include a heat exchanger and recirculator that are operative coupled to the heater 112 to ensure that fluid provided to the turbine 104 is at a desired temperature. For purposes of illustration, however, these additional components have been omitted.

The supercritical fluid that has been heated by the heater 112 can drive the turbine 104, which can in turn drive the motor/generator 102 to generate electrical power. The fluid 104 that exits the turbine will be at high temperature and low pressure (compared to temperature and pressure of fluid exiting the compressor 108). The fluid through recuperator 201, where heat from such fluid is relayed to the fluid in the first piping 110 that is to be provided to the heater 112. This fluid is then provided to the cooler 202 along the second piping 111, wherein the process can continually repeat.

In this exemplary recuperated supercritical Brayton cycle power generation system 200, one or more startup fluid flow issues may exist. The arrows on the first piping 110 and the second piping 111 show the as-designed (desired) flow direction of fluid in the power generation system 200. At startup of such system 200, however, the fluid may flow backwards through the first piping 110 and the second piping one 111, and therefore may flow backwards through the turbine 104, the compressor 108, and the heater 112. This backward flow of fluid is caused by high density of the fluid at lower temperatures (room temperatures) when compared to density of the fluid at as-designed temperatures. For instance, at cold startup of the power generation system 200, the density of the fluid in the turbine 104 can be several times larger than the density of the fluid at designed operating conditions. In other words, at cold startup, the tip of the turbine 104 is spinning faster than the flow velocity of the fluid through the inlet nozzles of the turbine 104. Therefore, the fluid cannot push against the blades of the turbine 104, but rather the blades of the turbine 104 push the fluid. When this happens, the turbine 104 can act as a compressor and can produce a back pressure that is proportional to $(\rho u^2)/2$, where $\rho$ is the density of the fluid and u is the tip speed of the turbine 104. For the power generation system 200, if the back pressure generated by the turbine 104 is greater than the pressure generated by the compressor 108, the fluid will flow backwards through the loop.

As mentioned previously, and as will be described in greater detail below, the sensor 114 can be placed at the inlet port 104A of the turbine 104 and can output sensed temperatures of the fluid at such inlet port 104A. Based at least in part upon this sensed temperature, at least one operating parameter of the power generation system 200 can be controlled. In other words, the at least one operating condition can be controlled in a manner that allows the heater 112 to preheat the fluid in the power generation system 200, thereby decreasing the density of the fluid and allowing the turbine 104 to act as a turbine rather than as a compressor.

Figure 3:
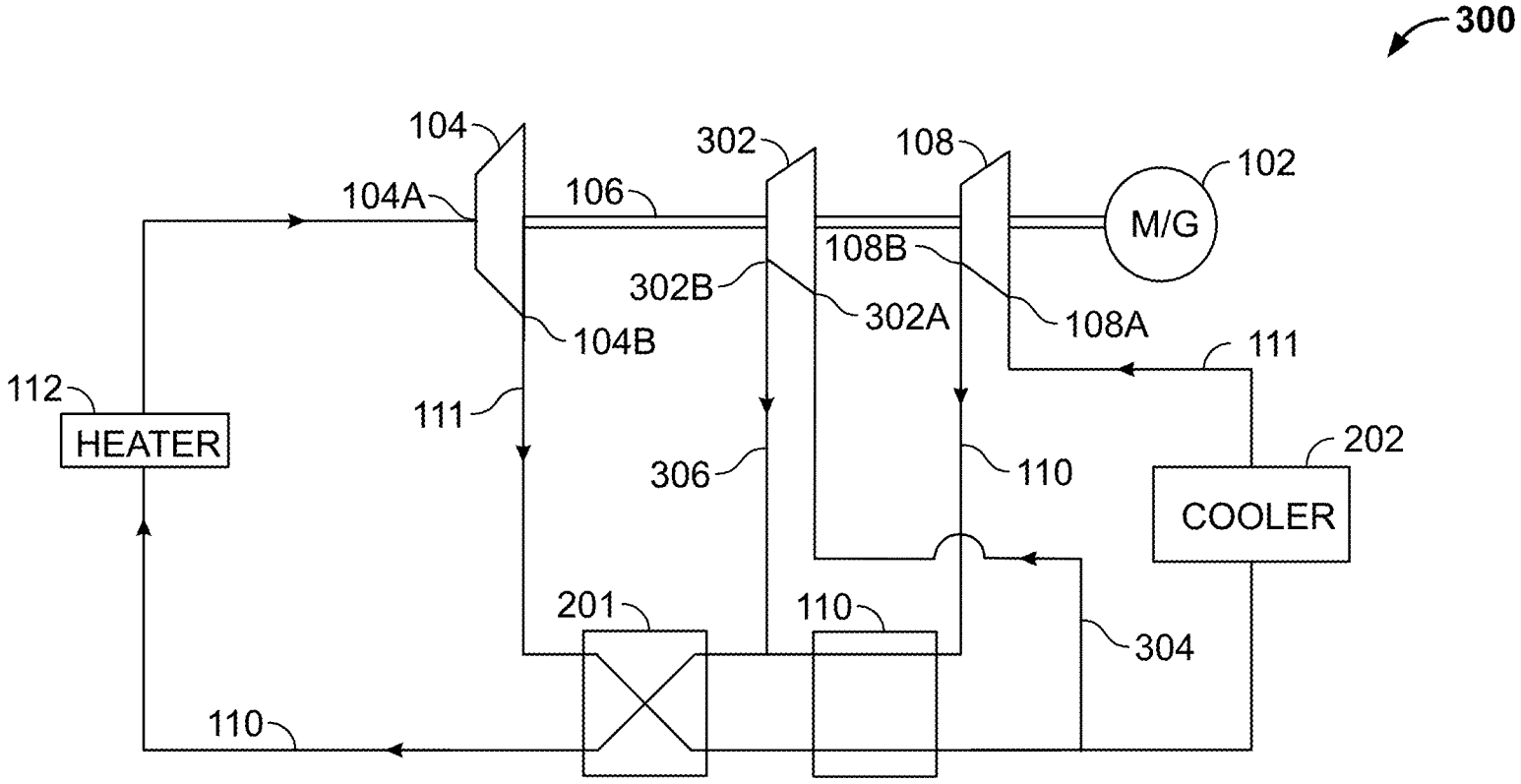
FIG. 3 is a schematic diagram of an exemplary recompression supercritical Brayton cycle power generation system.

Turning now to FIG. 3, an exemplary re-compressor supercritical Brayton cycle power generation system 300 is illustrated. The power generation system 300 comprises the motor/generator 102, the turbine 104, the shaft 106, the compressor 108, the first piping lines 110 the second piping lines 111, the heater 112, the recuperator 201, and the cooler 202, which act as described above. The power generation system 300 further comprises a re-compressor 302, which is included to further increase efficiency of the power generation system 300. The re-compressor 302 comprises an inlet port 302A and an outlet port 302B. Third piping 304 transfers fluid from the second piping 111 to the inlet port 302A of the re-compressor 302, which compresses such fluid and outputs the compressed fluid by way of fourth piping 306. The fourth piping 306 is operative to transport fluid to the first piping 110, where the fluid is transmitted by way of the first piping 110 through the recuperated 201 and the heater 112, and into the inlet port 104A of the turbine 104. Fluid exiting the turbine 104 is transported to the recuperator 201, where heat is transferred to fluid in the first piping 110. A low-temperature recuperator 308 transfers additional heat from the fluid in the second piping 111 to fluid exiting the main compressor 108 along the first piping 110. The fluid output from the low-temperature recuperator 308 is then provided to the inlet ports of the main compressor 108 and the recompressor 302, respectively. Arrows along the first piping 110, the second piping 111, the third piping 304, and the fourth piping 306 illustrate desired flow direction of the fluid during operation of the power generation system 300.

At cold startup of the supercritical Brayton cycle power generation system 300, however, the turbine 104 can act as a compressor as described above with respect to the power generation system 200. Additionally, at cold startup, it is also possible for the re-compressor 302 to generate higher outlet pressures than the main compressor 108. Again, this can occur because the density of the fluid provided to the re-compressor 302 at cold startup can be several times larger than the density of the fluid when at an as-designed temperature. Additionally, a wheel of the re-compressor 302 will be larger than a wheel of the main compressor 108, thereby causing the re-compressor to 302 creates larger pressure than the main compressor 108. Moreover, the re-compressor 302 can create larger pressures at startup regardless of whether the re-compressor uses radial or axial turbines.

Accordingly, at cold startup of the power generation system 300, the fluid can travel backwards through the turbine 104 and the main compressor 108, and can further travel backwards through the heater 112. Thus, the fluid will not be appropriately heated to cause the fluid to flow in the as-designed directions as indicated by the arrows shown in FIG. 3. Mechanisms are described herein that allow the heater 112 to preheat the fluid in the power generation system 300 to a temperature that causes the fluid to flow in the as-designed direction. The sensor 114 can be placed at the inlet port 104A of the turbine 104 to sense the temperature of the fluid at the inlet port 104A of the turbine 104. As mentioned previously, at least one operating condition of the power generation system 300 can be controlled based at least in part upon the sensed temperature at the inlet port 104A of the turbine 104. For instance, one or more of the heater 112 or the motor/generator 102 can be controlled based at least in part upon the sensed temperature at the inlet port 104A of the turbine 104. Furthermore, one or more valves on any of the piping (or bypass piping) can be selectively opened or closed based at least in part upon the sensed temperature at the inlet port 104A of the turbine 104. Still further, a pump can be controlled based at least in part upon the temperature sensed at the inlet port 104A of the turbine 104.

Figure 4:
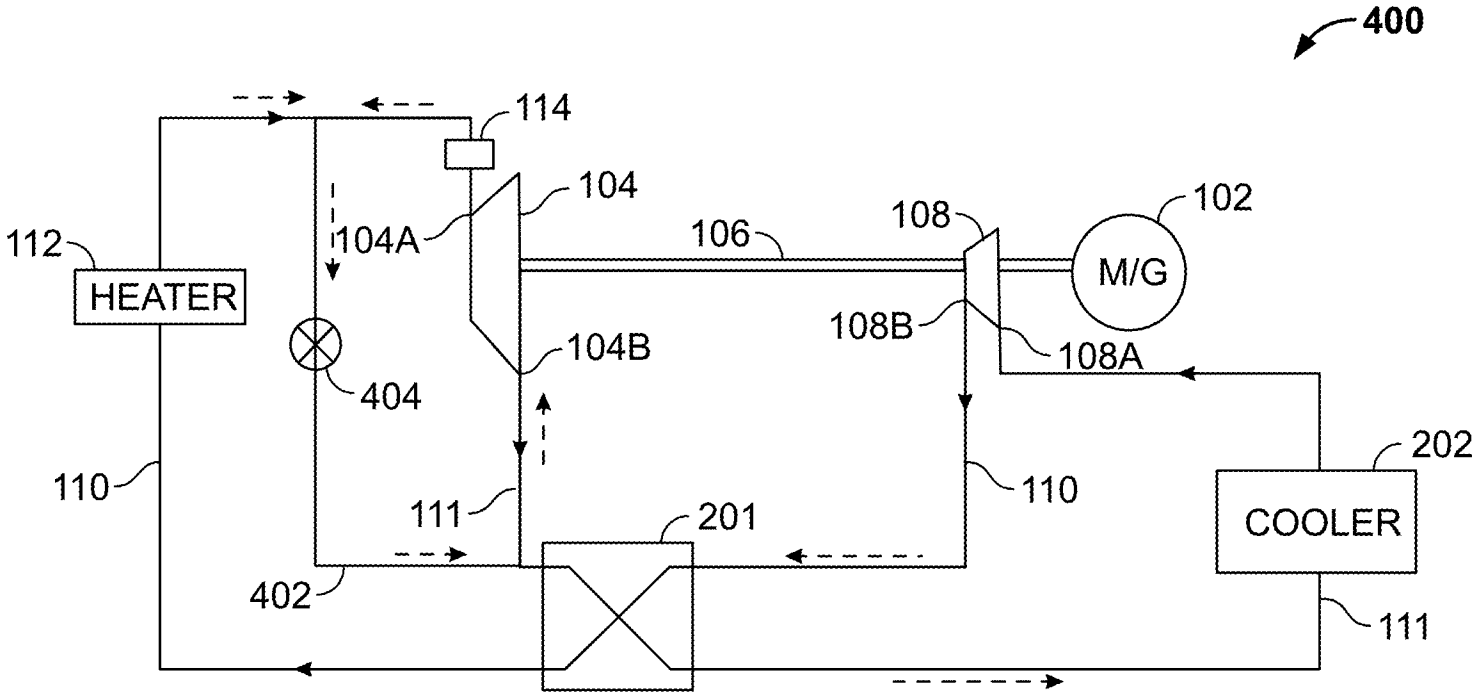
FIG. 4 is a schematic diagram of an exemplary recuperated supercritical Brayton cycle power generation system that includes bypass piping and corresponding valves.

Referring now to FIG. 4, another exemplary recuperated supercritical Brayton cycle power generation system 400 is illustrated. The power generation system 400 comprises the motor/generator 102, the turbine 104, the shaft 106, the compressor 108, the first piping 110, the second piping. 111, the heater 112, the recuperator 201, and the cooler 202, which act as described above. The power generation system 400 further comprises the sensor 114, which is configured to sense the temperature of the fluid at the inlet port 104A of the turbine 104.

The power generation system 400 further comprises fifth piping 402 that is operative to act as bypass piping for the turbine 104. A first valve 404 is positioned on the fifth piping 402, such that when the first valve 404 is open, the fifth piping 402 causes fluid to be transferred from the inlet port 104A of the turbine 104 to the outlet port 104B of the turbine 104. In other words, the fifth piping 402, when the first valve 404 is in the open position, is operative to transfer fluid from the first piping at the inlet of the turbine 104 to the second piping 111 at the outlet of the turbine 104.

The arrows on the first piping 110 and the second piping 111 illustrate the desired direction of fluid flow. The dashed lines shown with respect to the supercritical Brayton cycle power generation system 400 illustrate the flow of the fluid in the power generation system 400 prior to the temperature of the fluid being above a threshold at the inlet port of the turbine 104. Once the motor/generator 102 is turned on to drive the compressor 108, low pressure in the fifth piping 402 allows fluid exiting the compressor 108 to flow in the proper direction through the heater 112, and then bypass the turbine 104 by way of the fifth piping 402. Heat is then transferred from the fluid in the fifth piping 402 as the fluid transfers to the second piping 111, wherein heat is transferred in the recuperator 201 to fluid in the first piping 110. This is again provided to the heater 112 by way of the compressor 108, which further heats the fluid. As shown by way of the dashed arrows, flow of the fluid may still be reversed through the turbine 104. However, such fluid is directed through the low pressure leg (the fifth piping 402) when the valve 404 is open and not backwards through the heater 112. Once the sensor 114 outputs a sensed temperature that is above a predefined threshold temperature, the valve 404 may be relatively slowly closed (e.g. over five minutes, over 10 minutes, over one half an hour, over an hour, . . . ). As the first valve 404 is closed, the power provided by the motor/generator 102 to the compressor 108 and the turbine 104 will decrease as less power is used by the turbine 104 while it is acting as a compressor. The rate of closure of the first valve 404 can be selected to avoid flow reversal in the compressor 108. Pursuant to example, the first valve 404 can be closed when the temperature sensed by the sensor 114 is between 200° F. and 300° F.

The temperature sensed at the inlet port 104A of the turbine 104 can be utilized to control the opening and closing of the first valve 404 due to its pertinence to a $u/c_o$ ratio. At cold startup, fluid density in the turbine 104 may be relatively high when compared to density of the fluid when the system 400 is operating at as-designed temperatures. This means that the flow rate of the fluid through nozzles of the turbine 104 is low. At high enough shaft speeds, the tip of the turbine 104 may spin faster than is possible for the fluid to flow through the turbine inlet nozzles. When this occurs, the turbine 104 may act like a compressor and produce a back pressure that is proportional to $(\rho u^2)/2$, where $\rho$ is a fluid entity and u is the tip speed of the turbine 104.

For the turbine 104, the ability to function as a compressor can be measured by the ratio $u/c_o$. This is the ratio of the tip speed of the turbine 104 at the spouting velocity ($c_o$) across the turbine 104. Particularly, $u/c_o=2\pi Nr/\sqrt{2H_{ad}}$, where $c_o=\sqrt{2H_{ad}}$. The property $c_o$ is called the spouting velocity, which is a measure of the maximum velocity that the fluid can move after expanding through the nozzles of the turbine 104. Clearly this velocity must be greater than the tip speed of the turbine 104 for the turbine 104 to act as a turbine rather than as a compressor. In these equations, N is a shaft speed in revolutions per second, r is the tip radius of the turbine 104, $H_{ad}$ is the adiabatic enthalpy change across the turbine 104, which can depend on the temperature of the fluid at the inlet port 104A of the turbine 104 and pressure at the outlet port 104B of the turbine 104.

At cold startup of the power generation system 100, the high density of the fluid causes u to be greater than $c_o$. Accordingly, when $u/c_o$ is greater than 1, the turbine 104 may act as a compressor. Once the $u/c_o$ ratio decreases to below 1, the turbine 104 acts as a turbine and not a compressor. Accordingly, when the aforementioned ratio drops below 1, the first valve 404 may be closed. This particular startup condition of $u/c_o$ while being less thanl is equivalent to the inlet temperature at the turbine 104 exceeded a predefined temperature at fixed pressure and shaft speed. Thus, startup pressure and shaft speed utilized in the power generation system 400 (and other power generation systems described herein) are repeated, the temperature at the inlet of the turbine 104 can be monitored to determine when the fluid will flow correctly through the power generation system 400. For at least this reason, the temperature of the fluid at the inlet port 104A of the turbine 104 can be utilized to control at least one operating parameter of supercritical Brayton cycle power generation systems described herein.

Figure 5:
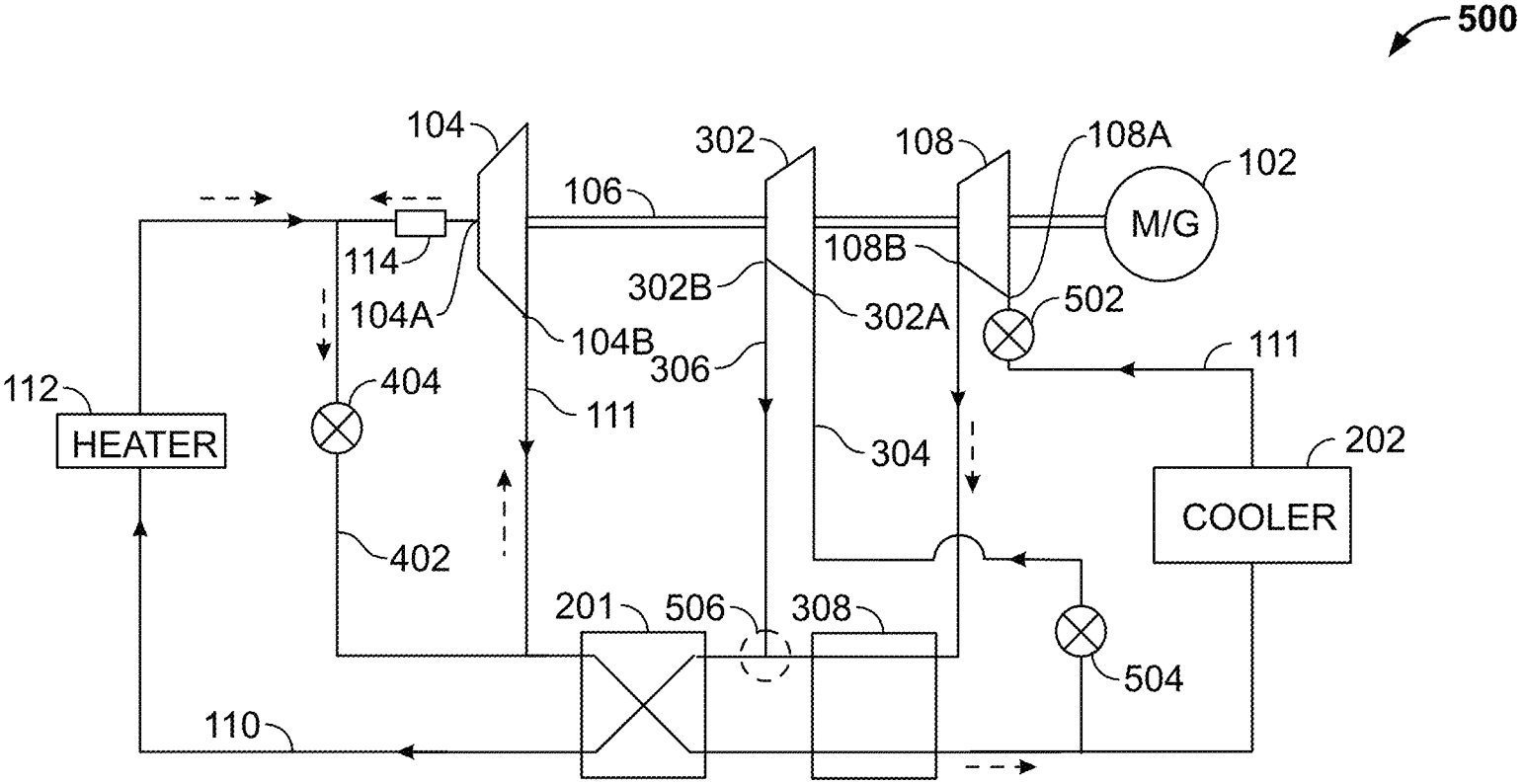
FIG. 5 is a schematic diagram of an exemplary recompression supercritical Brayton cycle power generation system that includes bypass piping and corresponding valve.

Now referring to FIG. 5 another exemplary re-compressor supercritical Brayton cycle power generation system 500 is illustrated, wherein such system includes bypass piping around the turbine 104. The power generation system 500 comprises the motor/generator 102, the turbine 104. the shaft 106, the main compressor 108, the re-compressor 302, the heater 112 the sensor 114 at the inlet port 104A of the turbine 104, the cooler 202, the first piping 110, the second piping 111, the third piping 304, and the fourth piping 306, with act as described previously with respect to the power generation system 300 shown and described in FIG. 3. Additionally, the power generation system 500 comprises the low-temperature recuperator 308 and the recuperator 201. The power generation system 500 further comprises a second valve 502 placed on the second piping 111, and a third valve 504 placed on the third piping 304.

The arrows on the first piping 110, the second piping 111, the third piping 304, and the fourth piping 306 illustrate desired flow of fluid in the power generation system 500 when such system is in operation (e.g., operating at as-designed temperatures and pressures). At cold startup of the power generation system 500, the third valve 504 can be closed, thereby preventing fluid to be provided to the inlet port 302A of the re-compressor 302. The second valve 502, however, may remain open. Additionally, the first valve 404, at cold startup, can be placed in the open position. Thus, the third valve 504 is closed or sufficiently closed to allow fluid exiting the main compressor 108 to be provided in the appropriate direction to the heater 112 in the first piping 110. This additionally causes avoidance of reverse flow of fluid through the main compressor 108. By closing the third valve 504, the power generation system 500 effectively becomes the recuperated or Brayton cycle power generation system 400 described in FIG. 4. That is, the compressor 108 can force fluid in the appropriate direction through the heater 112, and fluid traveling in the reverse direction through the turbine 104 can be directed over the fifth piping 402 (the bypass piping) when the first valve 404 is opened. This allows the heater 112 to preheat the fluid in order to drive the aforementioned $u/c_o$ ratio below 1. The sensor 114 can output a temperature at the inlet port 104A of the turbine 104, and based at least in part upon such temperature, the first valve 404 can be slowly closed, while the third valve 504 can be slowly opened. Additionally, the position of the second valve 502 can be altered to appropriately adjust pressures existent at the output ports of the main compressor 108 and the re-compressor 302.

In an example, the first valve 404 can be fully closed prior to the third valve 504 being opened. The third valve 504 can be opened at a rate that allows adjusting of the fraction of flow of fluid through the re-compressor 302 to the desired fraction of total fluid flow. Because the heater 112 has been operating, the fluid at the inlet port 302A to the re-compressor 302 has a density near the design point density, and therefore the tendency for the re-compressor 302 to cause the flow of fluid to be reversed through the main compressor 108 has been removed.

Moreover, in recompression Brayton cycle power generation systems (including the power generation system 500 and other recompression Brayton cycle power generation systems described herein), a union 506 is used to join the fluid flow between the fourth piping 306 and the first piping 110 (e.g., fluid exiting the main compressor 108 and the re-compressor 302). Ideally, these two flow streams have the same temperature and pressure; however, momentum effects and deviations caused by off-design operation can cause pressure in one of the streams (e.g., the fluid flow exiting the re-compressor 302) to exceed the pressure in the other one of the streams (e.g., the fluid flow exiting the main compressor 108). During cold startup, when the re-compressor 302 is operating at the same shaft speed as the main compressor 108, the fluid density received at the inlet port 302A of the re-compressor 302 may be several times higher than a desired density, as the fluid has yet to be heated. This can cause the flow of fluid to occur in a reverse direction from a desired direction. A particular type of union can be employed to increase stability of flow in a desired direction by utilizing momentum from one fluid flow stream to pump fluid in the lower velocity or lower pressure stream (even when velocity of fluid exiting the re-compressor 302 exceeds the velocity of fluid exiting the main compressor 108). For instance, a nozzle can be selectively positioned in the union 506 to assure a higher velocity of fluid in one of the flow streams. This can be referred to as an ejector pump union. Additionally, a lateral "T" union can be the union 506. Moreover, some other suitable "Y" configuration can also be utilized at the union 506.

Additionally, a particular type of union can be placed at an intersection 506 between the fourth piping 306 and the first piping 110. For instance, at such intersection 506 an ejector pump type union, a lateral union, or "Y" union can be utilized to facilitate proper fluid flow direction in the power generation system 500.

Figure 6:
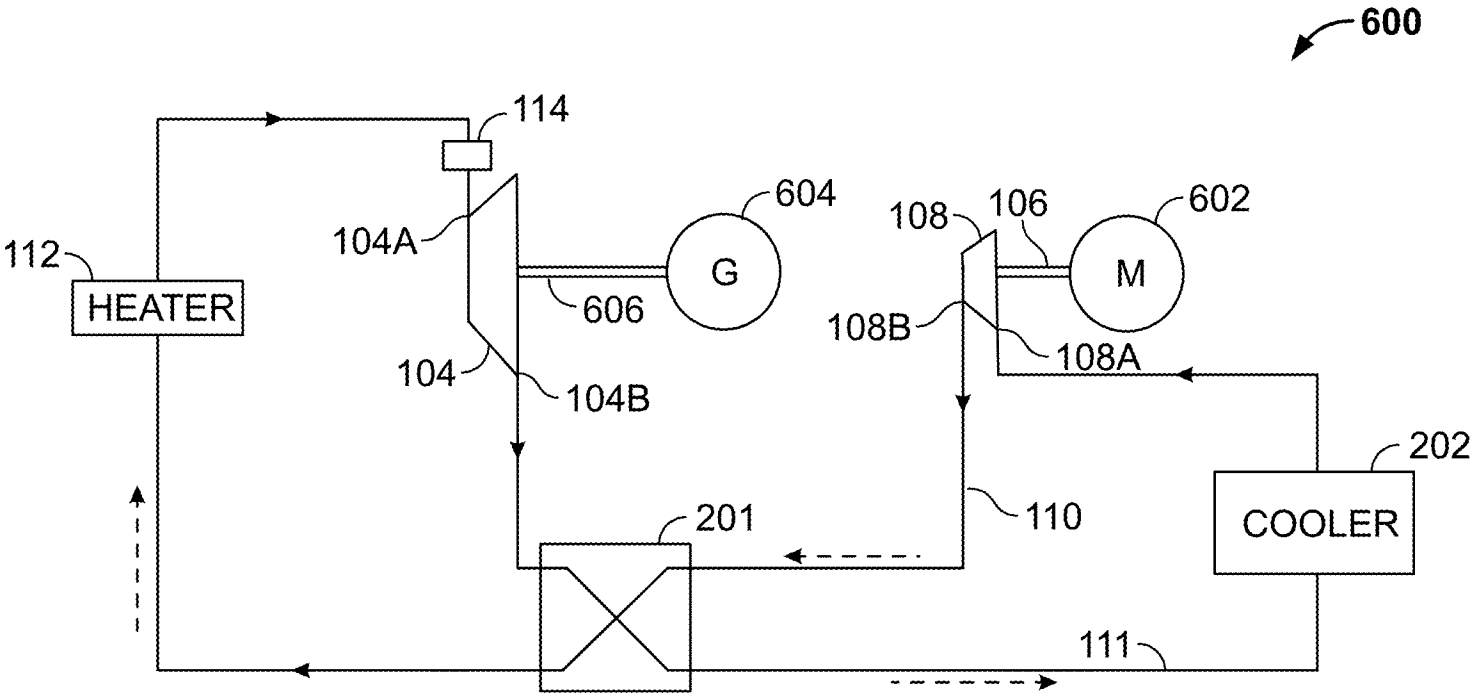
FIG. 6 is a schematic diagram of an exemplary recuperated supercritical Brayton cycle power generation system, wherein the turbine and compressor of such system operate on separate shafts.

Now referring to FIG. 6, another exemplary recuperator supercritical Brayton cycle power generation system 600 is illustrated. The power generation system 600 comprises a motor 602 that drives the compressor 108 by way of the shaft 106. The power generation systems 600 further comprises a separate generator 604 that is driven by the turbine 104 by way of a separate shaft 606. In other words, the compressor 108 is on a separate shaft from the turbine 104. At cold startup, the motor 602 is utilized to drive the compressor 108, which then forces fluid through the heater 112 by way of the first piping 110. It can be ascertained that the flow of the fluid is in the as-designed direction, as there is no mechanism that can cause reverse flow. The heater 112 may then be operated to preheat the fluid. The sensor 114 can monitor the temperature of the fluid at the inlet port 104A of the turbine 104, and such temperature can be utilized to ascertain the speed of the shaft 606 that causes the $u/c_o$ ratio to be below 1. When the estimate of the speed of the shaft 606 exceeds the idle speed of the turbine 104, the generator 604 can be motored or allowed to spin on its own. Once the turbine 104 begins spinning, the heater 112 can be controlled to cause the temperature of the fluid output from the heater 112 to be increased (e.g., additional power may be provided to the heater to increase the temperature of the fluid). Additionally, the motor 602 can be controlled to cause the compressor speed to increase, thereby increasing power production by the turbine 104. For instance, the generator 604 may be variable speed or synchronous. Pursuant to an example, a power generation system such as the one shown in FIG. 6 may be particularly useful in relatively small to intermediate power systems (utilized to generate between five and 10 MW of electric power). Accordingly, the temperature sensed by the sensor 114 at the inlet port 104A of the turbine 104 can be utilized, for instance, to control operation of the motor 602, the heater 112, and/or the generator 604.

Figure 7:
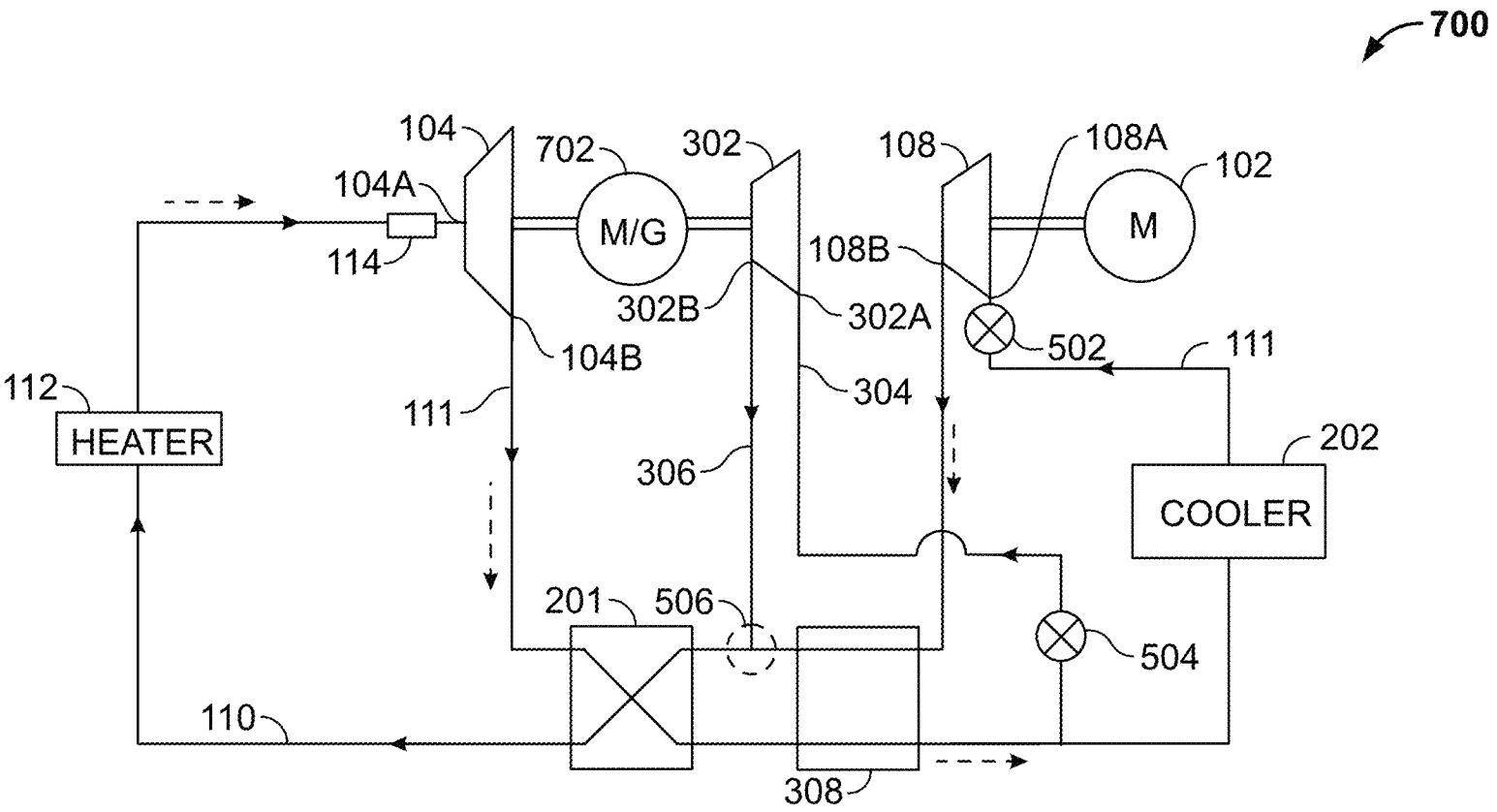
FIG. 7 is a schematic diagram of an exemplary recompression supercritical Brayton cycle power generation system, wherein the main compressor is on a separate shaft from the turbine and/or the re-compressor.

With reference now to FIG. 7, yet another exemplary supercritical Brayton cycle power generation system 700 is illustrated. In this exemplary power generation system 700, the re-compressor 302 and the turbine 104 are coupled by the shaft 106 while the main compressor 108 is driven by the motor 102 through a separate shaft (the shaft 106A). A motor/generator 702 is configured to drive the re-compressor 302 and be driven by the turbine 104. In the exemplary power generation system 700, the third valve 504 is initially closed at cold startup. Meanwhile, the second valve 502 on the second piping 111 can be opened, thereby allowing fluid to be provided to the main compressor 108. The main compressor 108 then forces fluid through the low-temperature recuperator 308 and the recuperator 201 to the heater 112, which can heat fluid that is provided to the turbine 104. It can be noted that the flow of the fluid is in the desired direction. Because the third valve 504 is closed at cold startup, there will be no reverse flow of fluid through the re-compressor 302. Once the flow of the fluid in the power generation system 700 is established, the heater 112 can be configured to preheat the fluid. The temperature of the fluid sensed by the sensor 114 at the inlet port 104A of the turbine 104 can be analyzed to monitor the $u/c_o$ ratio to determine the speed of the shaft 606 coupled to the turbine 104 that keeps $u/c_o$ ratio below 1. When the shaft speed estimate exceeds the idle speed of the turbine 104, the motor/generator 702 can be motored or allowed to stand on its own.

Once the turbine 104 is spinning, either by motoring or by expansion of fluid in the turbine 104, the third valve 504 can be slowly opened to allow fluid to be provided to the re-compressor 302. Pursuant to an example, the third valve 504 can be opened when the temperature of the fluid at the inlet of the turbine 104 as sensed by the sensor 114 is at or above a predefined threshold. Furthermore, speed of the re-compressor 302, the main compressor 108, and power provided to the heater 112 can be controlled or altered based at least in part upon temperature of the fluid at the inlet port 104A of the turbine 104 output by the sensor 114. Subsequent to the third valve 504 being fully opened, power provided to the heater 112 can be increased as can the speed of the main compressor 108 to increase power production created by way of the turbine 104. Additionally, as noted above, the motor/generator 702 connected to the turbine 104 can be operated at either variable speed or synchronous speeds. In an exemplary embodiment, at cold startup the motor/generator 702 can be operated at variable speed.

Figure 8:
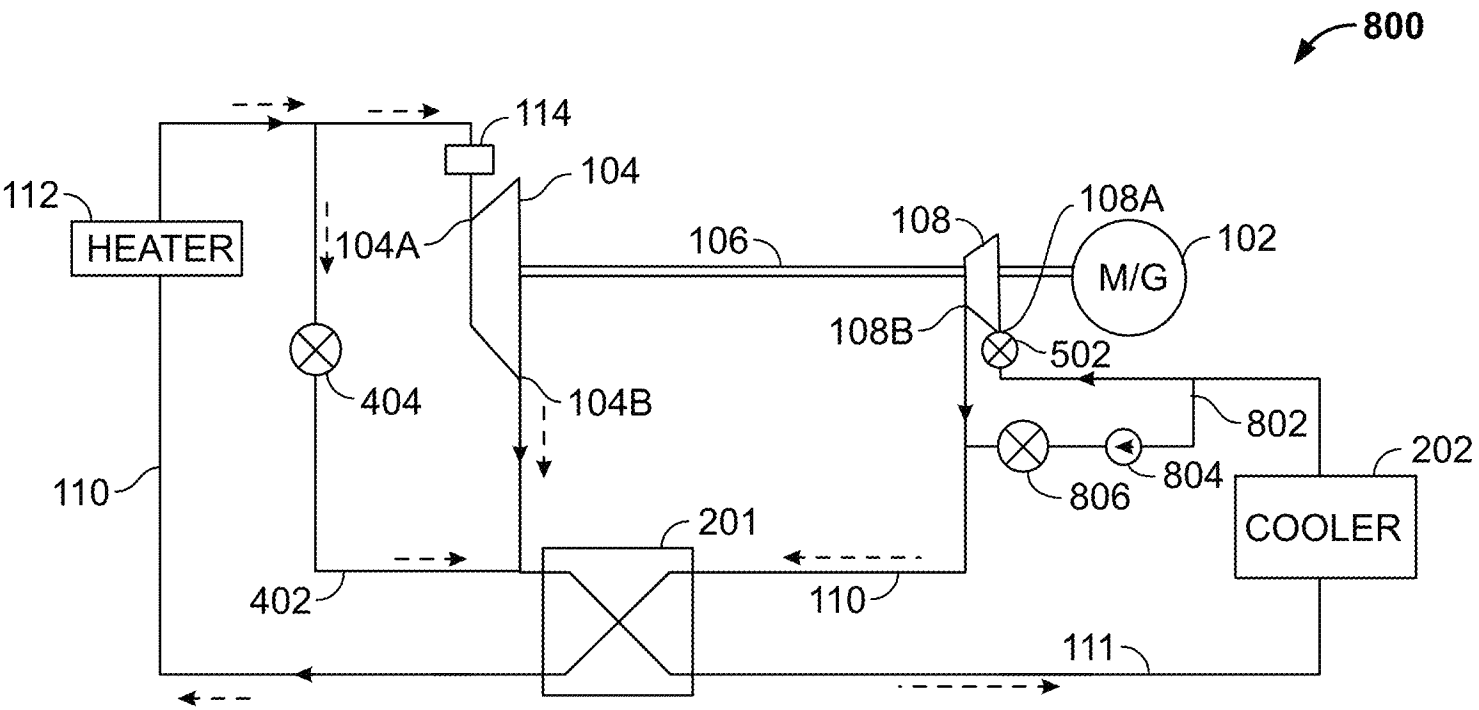
FIG. 8 is a schematic diagram of an exemplary recuperated supercritical Brayton cycle power generation system that includes a recirculator and an optional turbine bypass valve.

With reference now to FIG. 8, another exemplary recuperator supercritical Brayton cycle power generation system 800 is illustrated. The exemplary power generation system 800 comprises the motor/generator 102, the turbine 104, the shaft 106, the compressor 108, the first piping 110, the second piping, 111, the heater 112, the sensor 114, the bypass (fifth) piping 402, the first valve 404, and the cooler 202, which can operate as described above. The power generation system 800 can further comprise sixth piping 802 that acts as a bypass of the compressor 108. The power generation system 800 further comprises the second valve 502 that can be utilized to control fluid provide to the inlet port 108A of the compressor 108. Moreover, the sixth piping 802 has a recirculator or pump 804 thereon that is configured to pump fluid to the first piping 110 for receipt at the inlet of the heater 112. A fourth valve 806 can be opened to allow the recirculator 804 to pump fluid to the first piping 110 in the desire direction.

At cold startup, the compressor 108 can be isolated by closing the second valve 502 and opening the fourth of 806. Thereafter, the recirculator 804 can be initiated, which causes fluid to flow towards the first piping 110. The fifth piping 402 and the first valve 404 are optionally included to increase the speed at which the fluid is preheated. It is the understood that the fifth piping 402 and the first valve 404, in some embodiments, may not be included in the power generation system 800. The sensor 114 can output sensed temperature values at the inlet port 104A of the turbine 104, and such temperatures can be monitored to ascertain when the aforementioned $u/c_o$ ratio is below one. For predefined operational pressure and startup speed, such temperature can be known a priori.

Thereafter, the second valve 502 can be opened while the first valve 404 and the fourth valve 806 are closed. The rate of opening and closing of the valves 404, 502, and 806 can be undertaken to substantially optimize efficiency of the power generation system 800. The motor/generator 102 may then be configured to begin driving the compressor 108. This can be done, for instant, at approximately 30 to 40% of the design speed. Flow direction in the desired direction may then be confirmed, and additional power can be provided to heater 112 to further heat the fluid that is provided to the inlet port 104A of the turbine 104. The speed of the motor 102 may then be further increased, and heating can be continued until power generation begins. Thereafter, speed of the shaft 106 can be increased and heater power can be increased until a desired amount of electoral power is produced.

In this exemplary power production system 800, it is to be understood that one or more of the first valve 404, the second valve 502, and the fourth valve 806 can be controlled based at least in part upon the temperature of the fluid at the inlet port 104A of the turbine 104 as sensed by the sensor 114. Additionally, the motor/generator 102 can be controlled based at least in part upon the temperature sensed by the sensor 114 at the inlet port 104A of the turbine 104. Still further, power provided to the heater 112 can be controlled based at least in part upon the temperature sensed by the sensor 114 at the input port 104A of the turbine 104.

Figure 9:
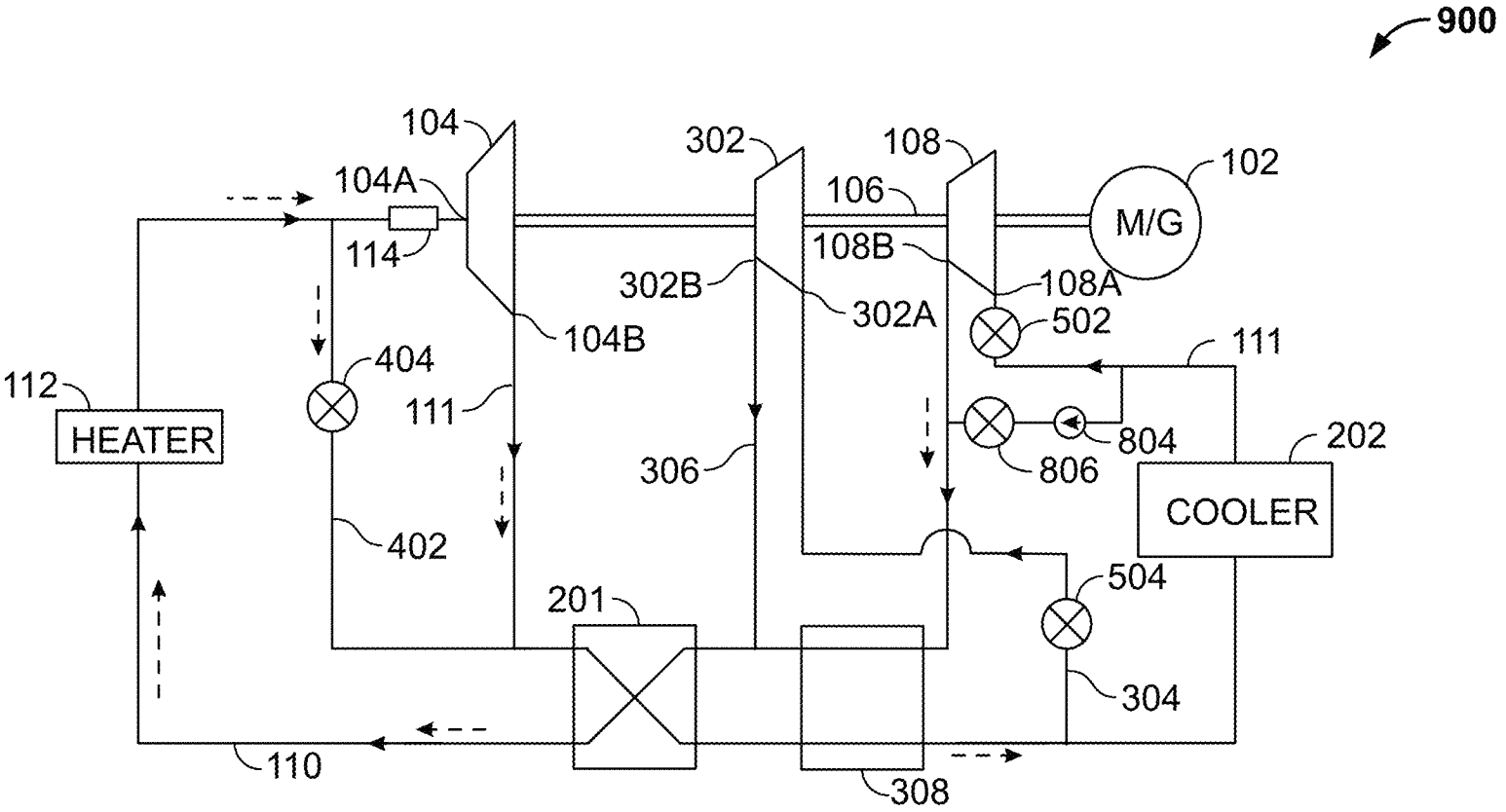
FIG. 9 is a schematic diagram of an exemplary recompression supercritical Brayton cycle power generation system that includes a recirculator and an optional turbine bypass valve.

With reference now to FIG. 9, still yet another exemplary re-compressor supercritical Brayton cycle power generation system 900 is illustrated. The power generation system 900 is similar to the power generation system 500 described above with respect to FIG. 5, and details pertaining to some aspects of operation of the power generation system 900 are omitted for the sake of brevity. A difference between the power generation system 900 shown in FIG. 9 and the power generation system 500 shown in FIG. 5 is the inclusion of the sixth piping 802, the pump 804, and the fourth valve 806. At cold startup of the power generation system 900, the first valve 404 may be opened, the second valve 502 may be closed to prevent fluid from being provided to the compressor 108, the third valve 504 may be closed to prevent fluid from being provided the re-compressor 302, and the fourth valve 806 may be opened to allow the pump 804 to pump fluid to the heater 112. To reduce the power requirements of the motor/generator 102, the third valve 504 can remain closed until the temperature of the fluid output by the sensor 114 reaches a predefined temperature, where at such temperature the turbine 104 is generating as much power as being consumed by the main compressor 108.

Furthermore, the third valve 504 can remain closed while the speed of the shaft 106 is increased from a starting shaft speed to an idle shaft speed, which may be, for instance, 40 to 50% of the full as-designed speed of the shaft 106. It can be noted, however, that in such a power generation system 900, the thrust load generated on the shaft 106 may be different when the third valve 504 is closed when compared to when the third valve 504 open. Therefore, the thrust load capacity of a thrust bearing must be able to not only operate at the design point, but also at the thrust load conditions from startup shaft speeds to break even shaft speeds with the third valve 504 being closed and opened. Since the pressure ratio in the compressor 108 and re-compressor 302 at the break even conditions are relatively small (approximately 1.2), the thrust load changes in the shaft can be easily tolerated for oil lubricated bearings that may be used in larger power systems.

Figure 10:
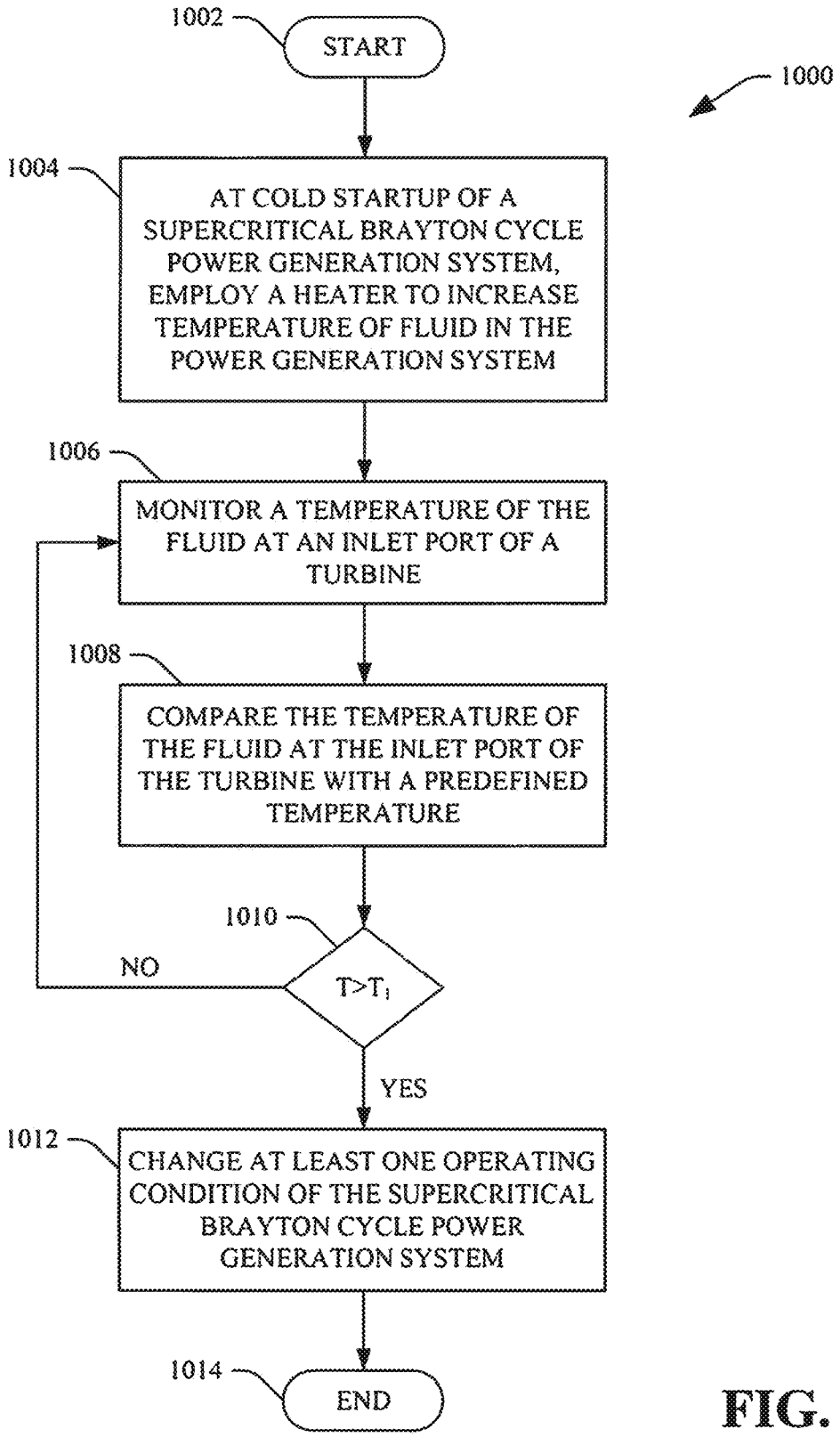
FIG. 10 is a flow diagram that illustrates an exemplary methodology for altering at least one operating condition of a supercritical Brayton cycle power generation system based at least in part upon a sensed temperature of fluid at an inlet port of a turbine in such system.

With reference now to FIG. 10, an exemplary methodology is illustrated and described. While the methodology is described as being a series of acts that are performed in a sequence, it is to be understood that the methodology is not limited by the order of the sequence. For instance, some acts may occur in a different order than what is described herein.

In addition, an act may occur concurrently with another act. Furthermore, in some instances, not all acts may be required to implement a methodology described herein.

Moreover, one or more of the acts in the methodology may be undertaken through execution of computer-readable instructions by one or more processors, wherein the computer-readable instructions are stored on a computer-readable medium or media. The computer-readable instructions may include a routine, a sub-routine, programs, a thread of execution, and/or the like. Still further, results of acts of the methodologies may be stored in a computer-readable medium, displayed on a display device, and/or the like. The computer-readable medium may be a non-transitory medium, such as memory, hard drive, CD, DVD, flash drive, or the like.

Turning now to FIG. 10, an exemplary methodology 1000 that facilitates changing at least one operating condition of a supercritical Brayton cycle power generation system is illustrated. The methodology 1000 starts at 1002, and at 1004, at cold startup of a supercritical Brayton cycle power generation system, a heater is employed to increase temperature of fluid in the power generation system. For instant such fluid may be, in an exemplary embodiment, carbon dioxide.

At 1006, a temperature of the fluid (T) at an inlet port of a turbine in the supercritical Brayton cycle power generation system is monitored. At 1008, the monitored temperature of the fluid at the inlet port of the turbine is compared with a predefined temperature ($T_1$). Such temperature can be selected to analyze a $u/c_o$ ratio as described above.

At 1010, a determination is made regarding whether the monitored temperature is greater than the predefined temperature. If the monitored temperature is less than the predefined temperature, then the methodology 1000 returns to act 1006, where the temperature at the inlet port of the turbine is continued to be monitored. If, however, the temperature at the inlet port of the turbine is greater than the predefined temperature, then at 1012 at least one operating condition of the supercritical Brayton cycle power generation system is altered. For instance, the at least one operating condition may be an amount of power provided to the heater, a speed of the motor, power provided to a pump, a position of a valve in the supercritical Brayton cycle power generation system, etc. The methodology 1000 completes 1014.

It is noted that several example designs of supercritical Brayton cycle power generation systems have been provided for purposes of explanation. It is to be understood that various features across designs can be combined to create a different supercritical Brayton cycle power generation system. Further, the exemplary designs are not to be construed as limiting the hereto-appended claims. Additionally, it may be recognized that some examples provided herein may be permutated while still falling under the scope of the claims.

What is claimed is:

1. A supercritical Brayton cycle power generation system, comprising:

a generator;

a turbine, wherein the turbine comprises an inlet port and an outlet port;

a shaft that operatively couples the turbine to the generator, wherein rotation of the turbine in a first radial direction is operative to cause the generator to output electric power;

a motor;

a compressor, wherein the compressor comprises an inlet port and an outlet port, wherein the motor is operative to drive the compressor;

a first piping that is operative to transport a fluid from the outlet port of the compressor to the inlet port of the turbine;

a second piping that is operative to transport the fluid from the outlet port of the turbine to the inlet port of the compressor;

a fifth piping that is operative to transport the fluid from the first piping to the second piping;

a first valve positioned on the fifth piping that is operative to direct the fluid in the first piping to flow to the second piping when the first valve is open;

a heater coupled to the first piping that is operative to heat the fluid;

a sensor coupled to the first piping that is operative to output a temperature of the fluid at the inlet port of the turbine; and a processor in communication with the sensor that controls the first valve's open or closed position based at least in part upon the temperature output by the sensor so that when the temperature of the fluid at the inlet port of the turbine is below a predefined threshold temperature, the processor causes the first valve to be in an open position;

wherein the first valve's open position directs fluid exiting from the heater and fluid exiting from the inlet of the turbine to the inlet port of the compressor when the temperature output by the sensor is below the predefined threshold temperature; and wherein the fluid driving the turbine is a single-phase fluid.

2. The supercritical Brayton cycle power generation system of claim 1, wherein the fluid is carbon dioxide.

3. The supercritical Brayton cycle power generation system of claim 1, wherein the fluid is a refrigerant.

4. The supercritical Brayton cycle power generation system of claim 1, wherein the shaft operatively couples the turbine with the compressor, and wherein the motor and the generator are comprised by a motor/generator unit.

5. The supercritical Brayton cycle power generation system of claim 1, further comprising:

a re-compressor, wherein the motor is further operative to drive the re-compressor, and wherein the re-compressor comprises an inlet port and an outlet port.

6. The supercritical Brayton cycle power generation system of claim 5, further comprising:

a third piping in fluid communication between the second piping and the inlet port of the re-compressor; and a fourth piping in fluid communication between the outlet port of the re-compressor and the first piping;

a union in fluid communication between the first piping and the fourth piping; and a second valve positioned on the second piping that is operative to direct the fluid in the second piping to flow into the compressor when the second valve is open;

a third valve positioned on the third piping that is operative to direct the fluid in the second piping to flow to the inlet of the re-compressor when the third valve is open;

wherein the third valve is controlled by the processor to be in an open position to cause fluid in the third piping to flow to the inlet of the re-compressor and by-pass the inlet port of the compressor if the temperature output by the sensor and received by the processor is below the predefined threshold temperature.

7. The supercritical Brayton cycle power generation system of claim 6, further comprising:

a sixth piping in fluid communication between the second piping and the first piping;

a fourth valve positioned on the sixth piping that is operative to direct the fluid in the second piping to flow to the first piping when the fourth valve is open; and a pump disposed on the sixth piping that is configured to pump the fluid through the heater and towards the inlet port of the turbine at startup of the supercritical Brayton cycle power generation system, wherein the fourth valve is controlled by the processor to be in an open position to direct fluid in the second piping to flow to the first piping and by-pass the inlet port of the compressor if the temperature output by the sensor and received by the processor is below the predefined threshold temperature.

8. A method that facilitates a cold startup of a supercritical Brayton cycle power generation system, the supercritical Brayton cycle power generation system including a processor, a heater, a turbine, a sensor, a compressor, and a valve, the valve being in respective fluid communication with an output of the heater and an inlet port of the turbine and an inlet of the compressor, the sensor being disposed at the inlet port of the turbine, and the processor being respectively operatively coupled to the sensor and the valve, the method comprising:

heating fluid by the heater so as to increase a temperature of the fluid, the heated fluid being received at the inlet port of the turbine;

monitoring a temperature of the heated fluid at the inlet port of the turbine by the sensor;

comparing, by the processor, the monitored temperature with a predefined threshold temperature; and changing the valve's open/close position, by the processor, from a closed position to an open position based on the comparison when the temperature of the fluid at the inlet port of the turbine is below the predefined threshold temperature so that the fluid output from the heater flows toward the valve and forms a combined fluid with fluid flowing from the inlet port of the turbine and the combined fluid flows through the valve to the inlet of the compressor, wherein the fluid that drives the turbine is a single-phase fluid.

9. The method of claim 8, wherein the fluid is carbon dioxide.

10. The method of claim 8, wherein the at least one operating condition further includes a speed of a motor that is utilized to drive a compressor in the supercritical Brayton cycle power generation system.

11. The method of claim 8, wherein the at least one operating condition further includes an amount of power provided to a pump that is configured to transport the fluid to the heater.

* * * * *